US007931018B1

(12) United States Patent
Lai

(10) Patent No.: US 7,931,018 B1
(45) Date of Patent: Apr. 26, 2011

(54) STRUCTURE OF PAINTBALL GUN

(76) Inventor: Bao-Shyan Lai, Taichung (TW)

( * ) Notice: Subject to any disclaimer, the term of this patent is extended or adjusted under 35 U.S.C. 154(b) by 31 days.

(21) Appl. No.: 12/627,046

(22) Filed: Nov. 30, 2009

(51) Int. Cl.
*F41B 11/00* (2006.01)

(52) U.S. Cl. ..... 124/77; 124/71; 124/72; 124/73; 124/74; 124/75; 124/76

(58) Field of Classification Search ..... 124/71–77
See application file for complete search history.

(56) References Cited

U.S. PATENT DOCUMENTS 4,850,330 A * 7/1989 Nagayoshi ..... 124/76
4,936,282 A * 6/1990 Dobbins et al. ..... 124/74
6,601,780 B1 * 8/2003 Sheng ..... 239/337
6,644,295 B2 * 11/2003 Jones ..... 124/77
6,925,997 B2 * 8/2005 Sheng ..... 124/74
7,299,796 B2 * 11/2007 Kirwan ..... 124/71
7,448,372 B2 * 11/2008 Lai ..... 124/74
7,461,646 B2 * 12/2008 Jones ..... 124/77
7,527,049 B2 * 5/2009 Sheng ..... 124/73
7,793,644 B2 * 9/2010 Lai ..... 124/77

* cited by examiner

*Primary Examiner* — Troy Chambers
(74) *Attorney, Agent, or Firm* — Wang Law Firm; Li K. Wang

(57) ABSTRACT

This specification discloses a structure of the paintball gun. It comprises a body, a pressuring set, and a triggering set. The body has an axial passage whose front end forms a paintball outlet. The triggering set and the pressuring set are disposed in sequence inside the passage. The triggering set has a bushing, a guide pillar, and a bolt. The bushing is fixed inside the passage. The bolt is mounted on the guide pillar and disposed together inside the bushing. Air after being pressurized by the pressing set enters the triggering set. A control valve controls the flow path of the air in the triggering set in order to push the guide pillar backward. The air thus pushes the bolt toward the paintball outlet of the passage for triggering.

5 Claims, 6 Drawing Sheets

STRUCTURE OF PAINTBALL GUN

BACKGROUND OF THE INVENTION

1. Field of Invention

The invention relates to a structure of bullet firing and pressure adjustment for a paintball fun. In particular, the invention relates to a gun structure that has the pressuring set disposed behind the triggering set, so that the paintball can be fired in a stable and safe way.

2. Related Art

FIG. 6 shows a conventional paintball gun. It mainly has a gun body 91, a bullet trigger 92, and a pressuring device 93. However, such a design has the following disadvantages:

1. The air-supplying pipe 96 extending from the pressurized gas tank 94 to the front holder 95 is exposed outside. In the paintball games, the user often needs to roll or hide. In these cases, the exposed pipe (i.e., the air-supplying pipe 96) is likely to have collisions with the environment and get damaged. Therefore, it has a shorter lifetime.

2. During the transportation of the pressurized gas, it goes from the pressurized gas bottle 94 under the handle 97 to the front holder 95 via the air-supplying pipe 96 upward and forward. It further passes through the intake path 98 and the outgoing path 99 at the bottom of the gun body 91 and reaches the rear side of the gun body 91 for firing the paintball. The airflow path is too long. As a result, the air may not have the desired pressure when it reaches the firing point. The firing range and point of fall are thus very different from the expectation. That is, the stability is not good.

3. The conventional paintball gun has a looser structure. Therefore, the size becomes too large for control. Most of the components, such as the air-supplying pipe 96, the pressurized gas tank 94, and the bullet trigger 92, are exposed to the environment. They are likely to be damaged due to collisions. At the same time, too many exposed components result in a bad spatial design. For example, the positions of the pressurized gas tank 94 and the air-supplying pipe 96 obviously make the user difficult to hold the gun. Of course, the inappropriate interior space design of the gun forbids the air pressure adjusting components from being put inside. Therefore, it has the problem in space organization.

SUMMARY OF THE INVENTION

In view of the foregoing, an objective of the invention is to provide a structure of a paintball gun. The pressuring set for adjusting the air pressure is disposed inside the body of the gun and behind the trigging set. The air transportation path after the pressure adjustment can be designed to be inside the gun body. This prevents possible damages due to collisions. Therefore, the invention is more sustainable and has a longer lifetime.

Another objective of the invention is to dispose the pressuring set behind the triggering set so that the high-pressure air at the pressuring set directly comes from the high-pressure source at the holder. It flows from the pressuring set forward to the triggering set and triggers the paintball. The air transportation path is shorter and more direct than the prior art. It prevents the problem of weaker air pressure at the triggering point. Therefore, the invention has better stability.

Yet another objective of the invention is to assemble the bushing, bolt, and guide pillar of the triggering set in a mounting method, rendering a better space use. In this case, the pressuring set is designed to be behind the triggering set. The invention thus achieves the advantages of smaller volume and more convenient manipulation. With such a design, the invention can prevent possible damages due to exposed components and achieve better space use. It is more convenient for the user to take and hold.

To achieve the above-mentioned objectives, the invention provides a gun body for a paintball gun. It comprises: a body, a pressing set, and a triggering set.

The body has an axial passage therein. The front end of the passage forms a paintball outlet. The rear end of the passage is defined with a pressuring space. An action space is defined between the paintball outlet and the pressuring space. The pressuring space has an air intake passage for taking in air from outside. A first flow path is formed in the body to communicate the pressuring space and the action space.

The pressuring set is disposed in the pressuring space of the passage and on the rear end thereof for adjusting the air pressure input via the intake passage.

The triggering set is disposed in the action space of the passage and includes a bushing, a guide pillar, and a bolt. The bushing is fixed in the action space. The bolt is mounted on the guide pillar and then disposed inside the bushing together. The pressurized air done by the pressuring set enters the triggering set via the first flow path. A control valve controls the flow path of the air inside the triggering set to push the guide pillar backward, thereby pushing the bolt to fire toward the paintball outlet.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

Figure 1:
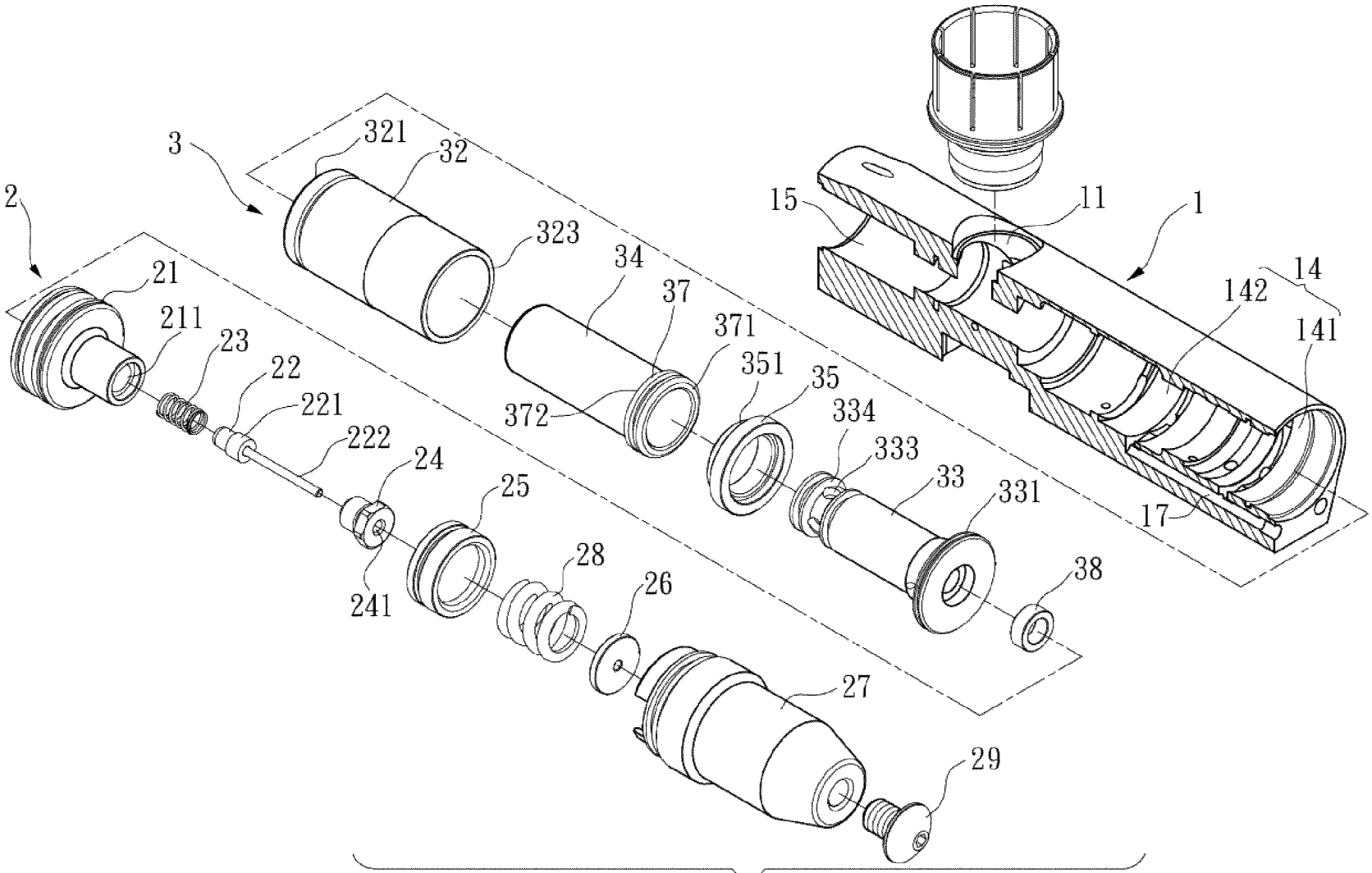
FIG. 1 is a three-dimensional exploded view of the invention and the cross sections of some of it components.

The present invention will be apparent from the following detailed description, which proceeds with reference to the accompanying drawings, wherein the same references relate to the same elements.

Please refer to FIGS. 1 to 5 for an embodiment of the disclosed structure of a paintball gun. The structure includes a body 1, a pressuring set 2, a triggering set 3, a paintball inlet 11, and a holder 13.

The body 1 has a passage 14 extending along the axial direction. The front end of the passage 14 forms a paintball outlet 15. The paintball outlet 15 is connected with the paintball inlet 11. They are perpendicular to each other in this embodiment. The rear end of the passage 14 is defined with a pressuring space 141. An action space 142 is defined between the paintball outlet 15 and the pressuring space 141. The pressuring space 141 of the body 1 has an air intake passage 16 for guiding air from outside into the gun body. The body 1 further has at least one first flow path 17 connecting the pressuring space 141 and the action space 142.

The pressuring set 2 is disposed in the pressuring space 141 of the passage 14 and on the rear end of the passage 14. The outer side of the gun holder 13 is provided with a high-pressure source, such as a high-pressure gas tank (not shown). The air provided by the high-pressure source goes from the air intake passage 16 of the body 1 to the pressuring set 2. The pressuring set 2 adjust the pressure of the input air flowing through the air intake passage 16. The pressuring set includes a base 21, a pin base 22, a first spring 23, a pin base screw 24, a piston 25, a bottom plug 26, a pressurizer shell 27, and a second spring 28. The base 21 has an accommodating space 211 receding from one side. The first spring 23 is accommodated in the accommodating space 211 along the axial direction of the passage 14. One end of the pin base 22 urges against one end of the first spring 23. In practice, the pin base 22 has an urging part 221 to urge against one end of the first spring 23.

The pin base screw 24 is disposed at the opening of the accommodating space 221. The pin base screw 24 also has a hollow part 241 along the axial direction of the passage. The other end of the pin base 22 has an urging rod 222 going through the hollow part 241. In practice, one end of the urging rod 222 connects to the urging part 221. The other end of the urging rod 222 urges against the piston 25. A gap exists between the urging rod 222 and the hollow part 241 for air to flow through.

The pressurizer shell 27 is disposed on the rear end of the body 1. The piston 25 and the bottom plug 26 are disposed on both sides inside the pressurizer shell 27. The second spring 28 is disposed between the piston 25 and the bottom plug 26. The piston 25 can be pushed by the air backward to compress the second spring 28. The rear side of the pressurizer shell 27 is screw-fastened with a pressuring element 29, whose front end urges against the bottom plug 26 for pressure adjustments.

An annular gap 215 is formed around the base 21. A second flow path 216 goes through the annular gap 215 in the radial direction to the accommodating space 211. The second flow path 216 can further connect to the air intake passage 16 of the body 1 via the annular gap 215.

The triggering set 3 is disposed in the action space 142 of the passage 14, between the paintball outlet 15 and the pressuring set 2. It includes a bushing 32, a guide pillar 33, a bolt 34, and an air-stopping element 35. The bushing 32 is fixed in the action space 142. The bolt 34 is mounted on the guide pillar 33 and then disposed together inside the bushing 32. The rear end of the guide pillar 33 is provided with an urging element 38. An airflow space 36 is formed between the rear end of the guide pillar 33 and the front end of the base 21. An annular protrusion 331 is provided around the rear end of the guide pillar 33. The air-stopping element 35 is mounted on the annular protrusion 331 of the guide pillar 33. In this embodiment, the rear side of the air-stopping element 35 urges against the front sidewall of the annular protrusion 331. Moreover, the air-stopping element 35 has a bending part 351. The air-stopping element 35 can move with the guide pillar 33, so that the bending part 351 can touch or leave the rear end 323 of the bushing 32.

The front end of the guide pillar 33 has an air outlet 332. At least one air-guiding hole 333 in connection with the air outlet 332 is formed on the sidewall of the guide pillar 33 in the radial direction near the air outlet 332. In this embodiment, four air-guiding holes 333 are formed symmetrically in the up, down, left, and right directions. An annular groove 334 in fluid communications with the air-guiding holes 333 is formed around the front end of the guide pillar 33. At the moment of triggering, the annular groove 334 allows air to flow through and then enter the bolt 34.

A third flow path 335 is formed in the guide pillar 33 for the air to flow back and release its pressure. More explicitly, the third flow path 335 enables the air near the air outlet 332 to flow back to the space between the bushing 32 and the guide pillar 33. This mechanism releases the pressure after firing.

The bolt 34 slides between the bushing 32 and the guide pillar 33. At least one connecting hole 322 is formed near the front end 321 of the bushing 32. In practice, there can be two connecting holes 322 above and below. The high-pressure air entering the action space 142 via the first flow path 17 can flow via the connecting holes 322 into the space between the bushing 32 and the bolt 34. A receiving part 37 that can be driven by the air is formed around the rear end of the bolt 34. The side of the receiving part 37 toward the air-stopping element 35 forms a first receiving surface 371. The side of the receiving part 37 far from the air-stopping element 35 forms a second receiving surface 372. The bolt 34 urges against the front end of the air-stopping element 35 with the first receiving surface 371 of its receiving part 37. The front end of the bolt 34 has several vent holes 341 in fluid communications with the air outlet 332. As the air drives the bolt 34 to slide forward, the outer wall of the bolt 34 seals the paintball inlet 11. The pressure-adjusted air thus flows along the passage and by the bolt 34 toward the air outlet 341, forcing the paintball to escape via the paintball outlet 15.

An air control valve 18 is provided below the body 1. The control valve 18 is connected with the trigger 19 of the paintball gun. One end of the control valve 18 is in fluid communications with the space between the inner walls of the passage 14 of the body 1 and the bushing 32 via a fourth flow path 181. Its other end is in fluid communications with the air flow space 36 between the rear end of the guide pillar 33 and the front end of the base 21 via a fifth flow path 182.

Using the mechanism described above, the high-pressure air adjusted by the pressing set 2 enters the triggering set 3 in the action space 142 via the first flow path 17. The control valve 18 controls the flow path of air inside the triggering set 3 to force the guide pillar backward. The air thus pushes the second receiving surface 372 of the receiving part 37 of the bolt 34, thereby triggering in the direction of the paintball outlet 15.

Figure 2:
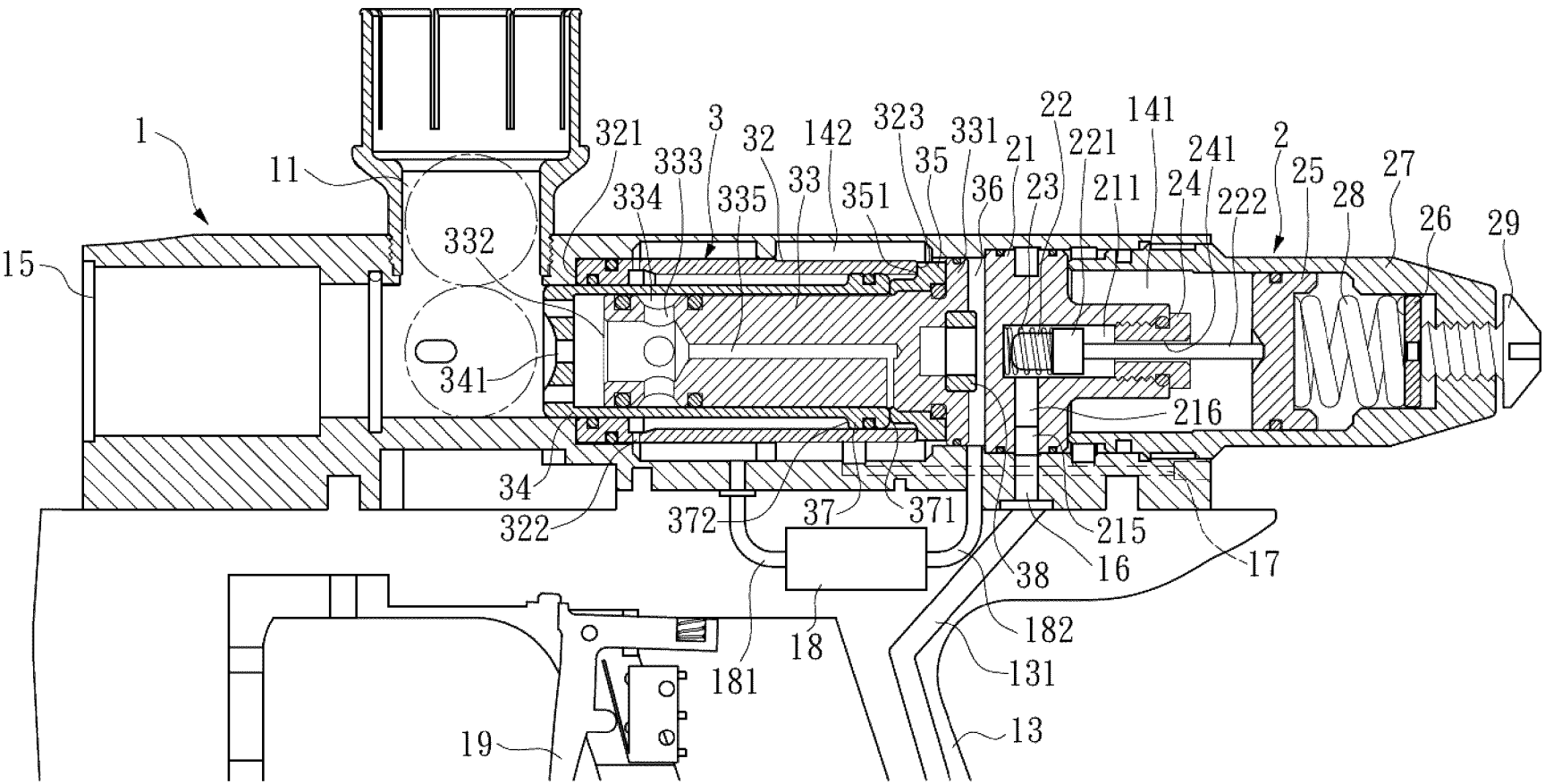
FIG. 2 is a cross-sectional view of the disclosed gun as the high-pressure air of the high-pressure source is just guided to the passage.

Please refer to FIG. 2 for the invention in use. As one turns on the high-pressure source the high-pressure air goes in sequence through the air-transporting passage 131 in the holder 13, the air intake passage 16, the annular gap 215, and the second flow path 216 and enters the accommodating space 211 of the base 21. The high-pressure air also flows via the gap between the urging rod 222 and the hollow part 241 to the air-adjusting space 141 between the piston 25 and the base 21. At the same time, the high-pressure air flows via the first flow path 17 in the pressuring space 141 to the passage 14 between the bushing 32 and the inner walls of the body 1. It then enters the space between the bushing 32 and the bolt 34 via the connecting holes 322 on the bushing 32.

The high-pressure air further flows via the fourth flow path 181, the control valve 18, and the second flow path 182 into the airflow space 36 formed between the rear end of the guide pillar 33 and the front end of the base 21. The high-pressure air thus urges against the rear end of the guide pillar 33, urging the bending part 351 of the air-stopping element 35 on the guide pillar 33 tightly against the rear end of the bushing 32.

More explicitly, the cross section of the airflow space 36 is designed to be larger than that of the second receiving surface 372 of the bolt 34. Therefore, with the same amount of air, the forward action generated by the airflow space 36 is larger than the backward action on the second receiving surface 372 of the bolt 34. The bending part 351 of the air-stopping element 35 on the guide pillar 33 thus urges tightly against the rear end of the bushing 32.

Figure 3:
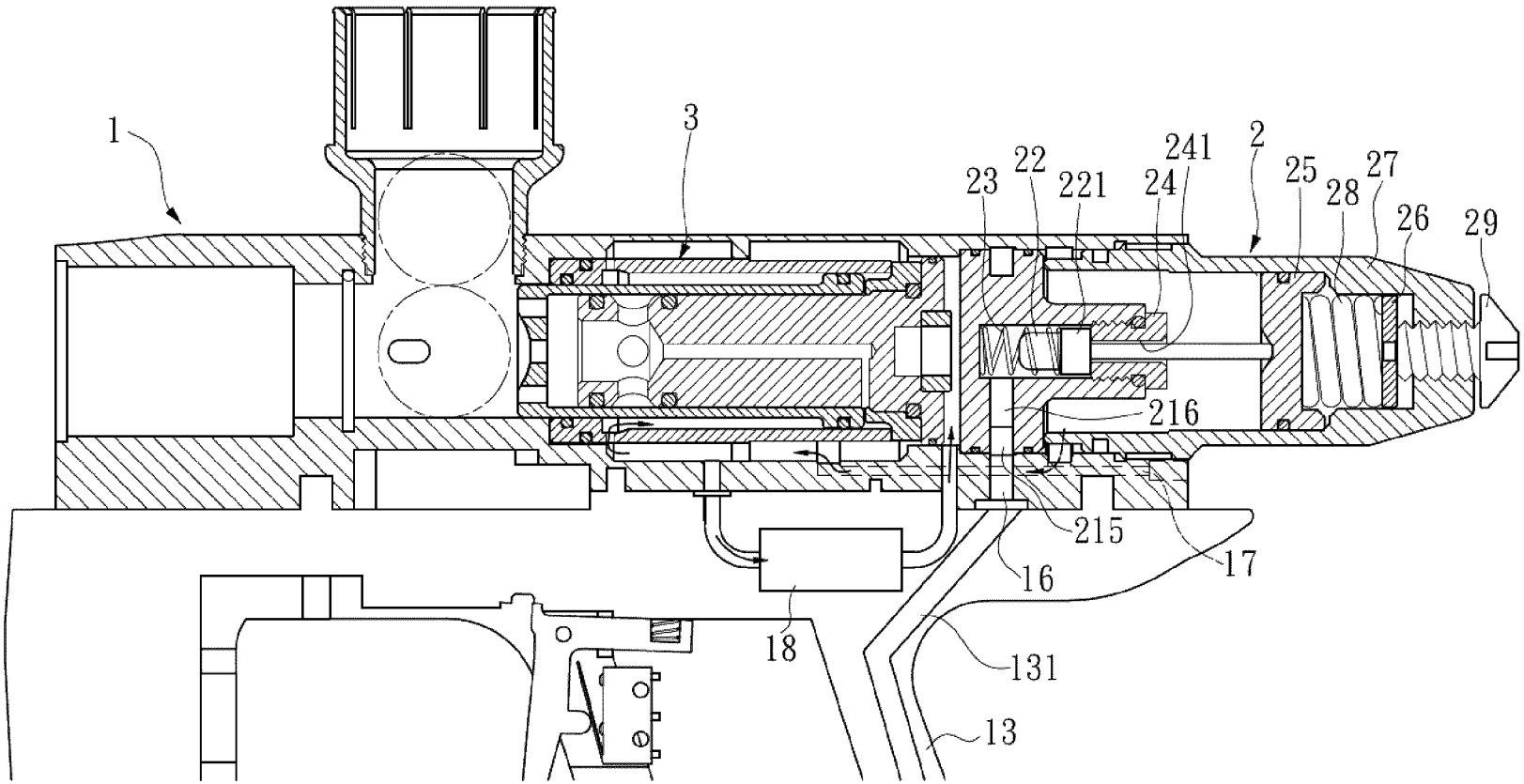
FIG. 3 is a cross-sectional view of the disclosed gun as the input high-pressure air has reached the predetermined pressure.

Please refer to FIG. 3. After the pressure of the air to enter the pressuring space 141 reaches a predetermined value, i.e., when the air pressure experienced by the piston 25 is larger than the tension on the second spring 28, the piston 25 moves backward toward the bottom plug 26. In this case, the pin base 22 is driven by the air pressure to push the urging part 221 backward. The opening of the hollow part 241 of the pin base screw 24 is then sealed by the sidewall of the urging part 221. Therefore, the high-pressure air at the high-pressure source temporarily cannot enter the pressuring space 141, thereby adjusting the pressure. To adjust the pressure value, one can turn the pressuring adjusting element 29 and adjust its position to produce the desired pressure.

Figure 4:
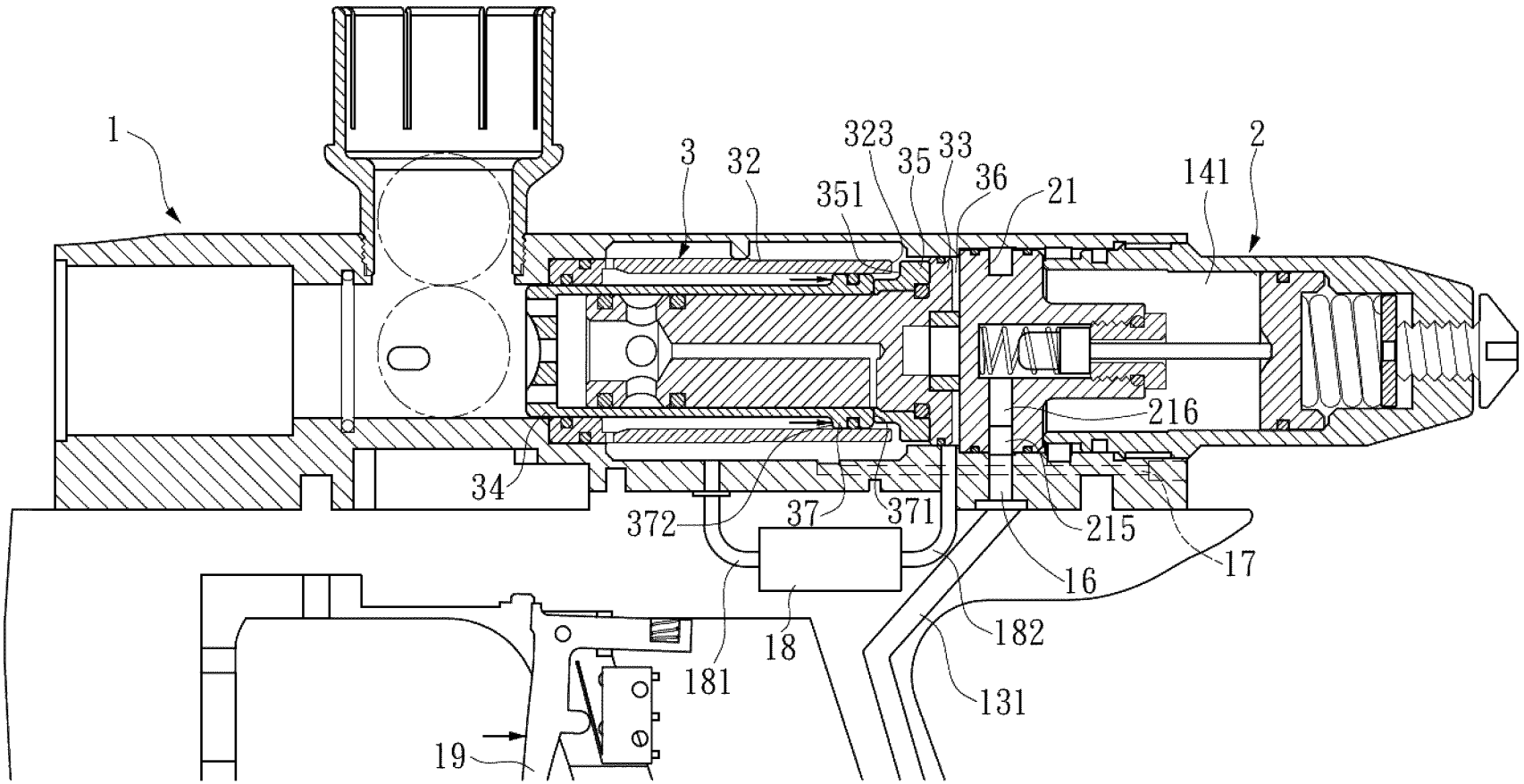
FIG. 4 is a cross-sectional view of the disclosed gun when the trigger is pulled and the high-pressure air forces the bending part of the air-stopping element to leave the rear end of the bushing.

Please refer to FIG. 4. When the user pulls the trigger 19, the trigger 19 moves the control valve 18 so that the gas between the fourth and fifth flow paths 181, 182 is blocked. The air pressure in the airflow space 26 between the rear end of the guide pillar 33 and the front end of the base 21 is released. As a result, the bolt 34 is driven by the backward action of the second receiving surface 372 of the receiving part 27 to push the air-stopping element 35 to move backward with the guide pillar 33. The bending part 351 of the air-stopping element 35 then leaves the rear end 323 of the bushing 32. In this case, a space forms between the rear end 323 of the bushing 32 and the bending part 351 of the air-stopping part 35 for pressure-adjusted air to flow through.

Figure 5:
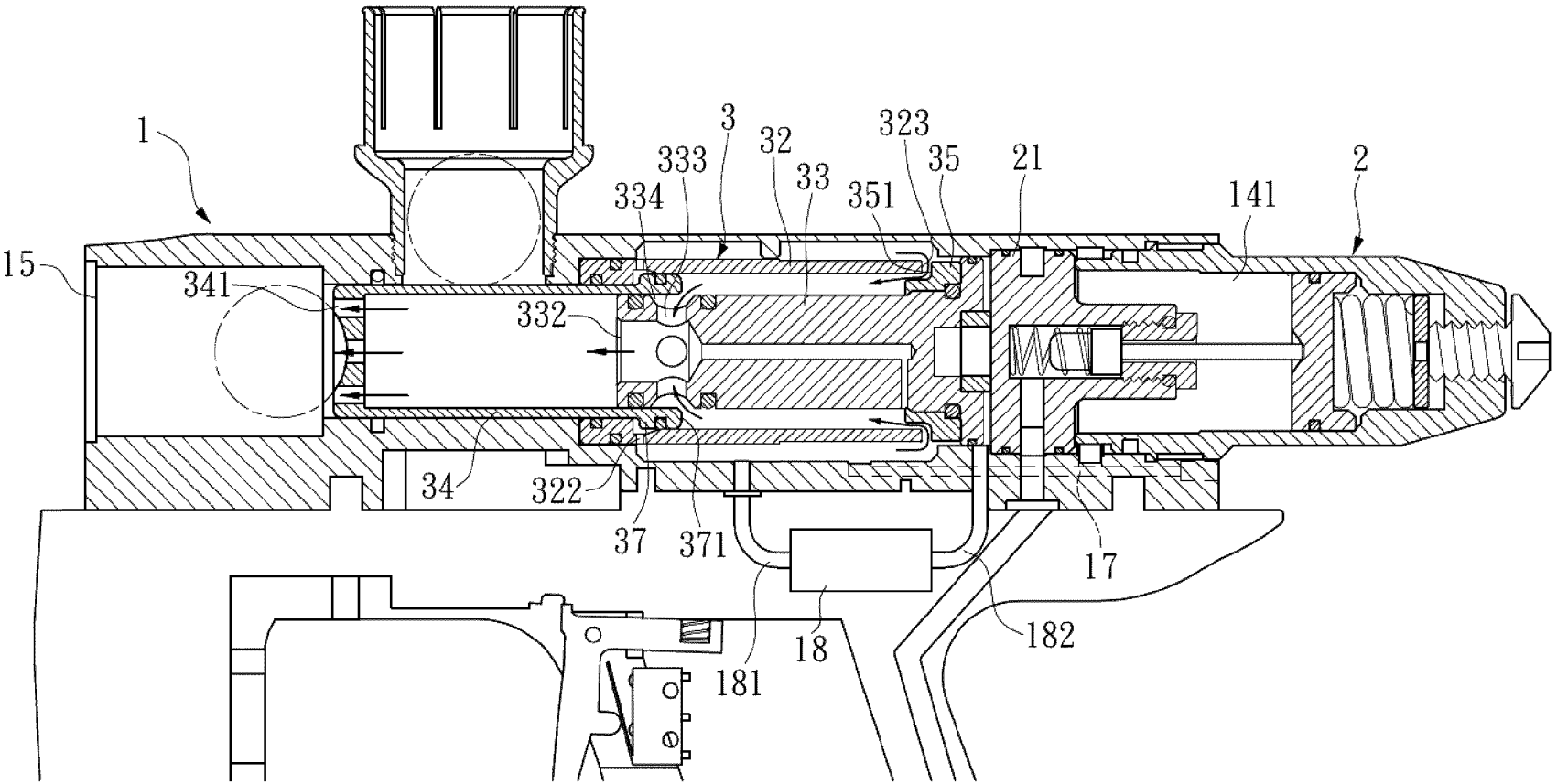
FIG. 5 is a cross-sectional view of the disclosed gun when the trigger is pulled and the high-pressure air drives the bolt to fire.
Figure 6:
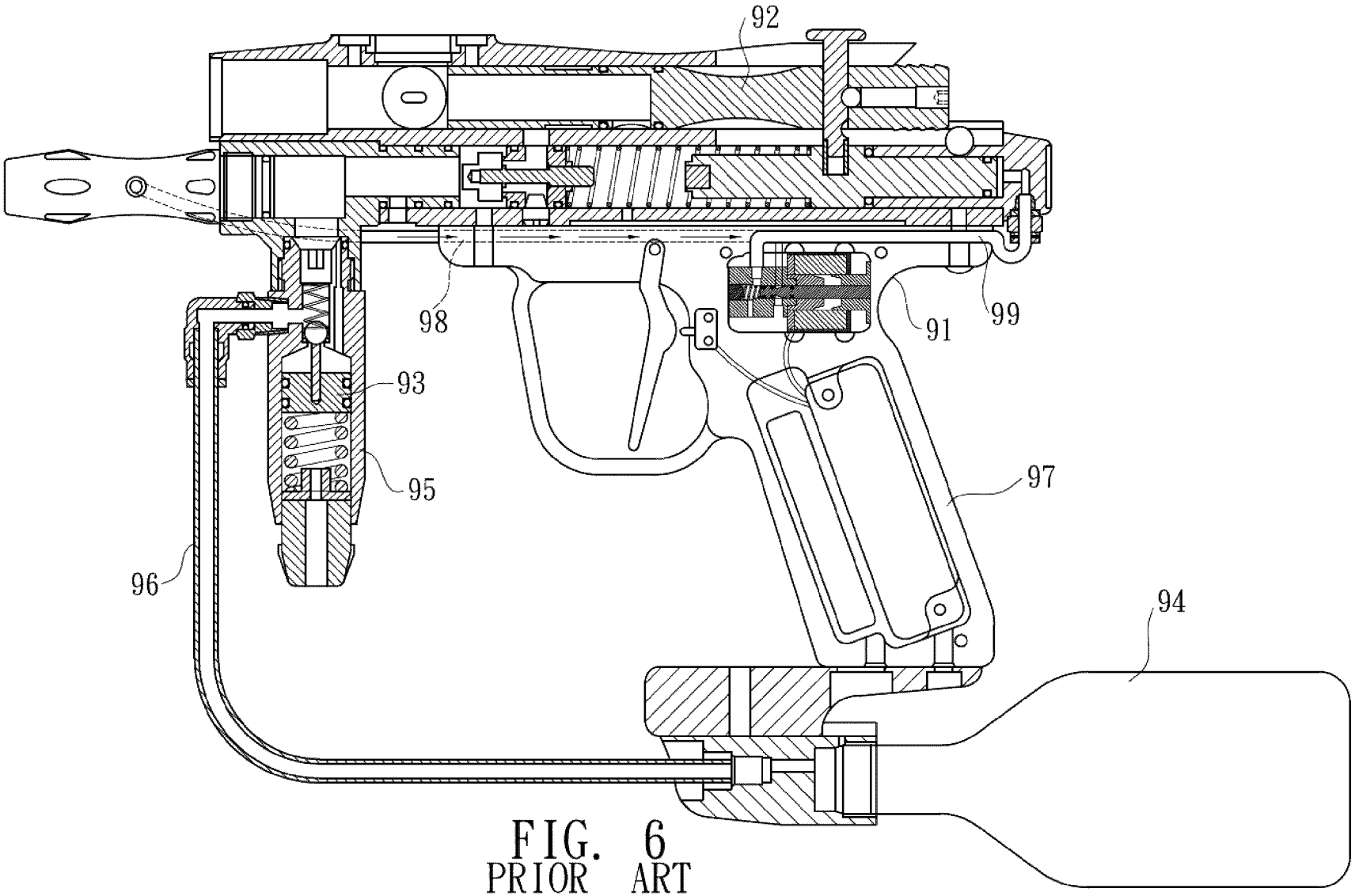
FIG. 6 PRIOR ART
FIG. 6 is a schematic view of a conventional paintball gun.

As shown in FIG. 5, the high-pressure air flows into the space between the rear end 323 of the bushing 32 and the bending part 351 of the air-stopping element 35. Since the first receiving surface 371 of the receiving part 37 of the bolt 34 is designed to have a larger cross section than the second receiving surface 372, the first receiving surface 371 of the receiving part 37 is pushed by the high-pressure air to move the bolt 34 forward. The receiving part 37 moves to the connecting holes 322 near the front end of the bushing 32. As the bolt 34 moves forward, the receiving part 37 pushes the air to flow back to the space between the bushing 32 and the passage 14 via the connecting holes 322. The outer wall of the bolt 34 can further seal the paintball inlet 11.

We now describe how the paintball is ejected. As the bolt 34 moves forward, the air in between the bushing 32 and the guide pillar 33 enters the bolt 34 via the annular groove 334, the air-guiding hole 333, and the air outlet 332 in sequence. It then leaves via the air outlet 341 in the front. The paintball is then pushed to leave the paintball outlet 15 by the high pressure. Of course, as the bolt 34 moves forward, it pushes the paintball forward too.

In summary, according to the invention, the paintball outlet, the triggering set, and the pressuring set are designed to be on the axis of the body passage. Therefore, it has the following advantages.

1. There is no exposed air pipe. Therefore, there is no problem of damages due to collisions as in the prior art. It is thus more sustainable and has a longer lifetime.

2. The pressuring set is disposed behind the triggering set. The path for the high-pressure air to reach the triggering set is shorter. The invention thus does not have the problem of insufficient pressure in the prior art. It has better stability in firing the paintball.

3. The elements in the disclosed triggering set and pressuring set are optimized in their spatial arrangement. For example, the bushing, bolt, and guide pillar of the triggering set are mounted over each other to effectively reduce the size of the gun. The saved space allows the installation of the pressuring set behind the triggering set. Therefore, the space is optimally used and the gun is easier to hold. There are no such problems as large sizes, exposed components, complicated elements, and difficulty in holding as in the prior art.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A structure of a paintball gun, comprising:

a body, which has an axial passage whose front end forms a paintball outlet and whose rear end is defined with a pressuring space; wherein an action space is defined between the paintball outlet and the pressuring space, the pressuring space has an air intake passage for taking in air from outside, and a first flow path is formed in the body to communicate the pressuring space and the action space;

a pressuring set, which is disposed in the pressuring space of the passage and on the rear end thereof for adjusting the air pressure input via the intake passage; and a triggering set, which is disposed in the action space of the passage and includes a bushing, a guide pillar, and a bolt; wherein the bushing is fixed in the action space, the bolt is mounted on the guide pillar and then disposed inside the bushing together, the pressurized air done by the pressuring set enters the triggering set via the first flow path, and a control valve controls the flow path of the air inside the triggering set to push the guide pillar backward, thereby pushing the bolt to fire toward the paintball outlet.

2. The structure of a paintball gun as in claim 1 with the pressuring set including a base, a pin base, a first spring, a pin base screw, a piston, a bottom plug, a pressurizer shell, and a second spring; wherein the base has an accommodating space receding from one side; the first spring is accommodated in the accommodating space along the axial direction of the passage; one end of the pin base urges against one end of the first spring; the pin base screw is disposed at the opening of the accommodating space, the pin base screw also has a through hollow part; the other end of the pin base has an urging rod going through the hollow part; a gap exists between the urging rod and the hollow part for air to flow through; the pressurizer shell is disposed on the rear end of the body; the piston and bottom plug are disposed in the pressurizer shell; the second spring is disposed between the piston and the bottom plug for pushing the piston; the piston surface opposite to the second spring touches the rear end of the urging rod, an annular gap forms around the base; the annular gap has a second flow path to the accommodating space in the radial direction; and the second flow path is in fluid communications with the intake passage of the body via the annular gap.

3. The structure of a paintball gun as in claim 2, wherein the rear side of the pressurizer shell is screwed with a pressuring element whose front end urges against the bottom plug.

4. The structure of a paintball gun as in claim 1, wherein the rear end of the guide pillar of the triggering set is connected with an urging element; an airflow space is formed on the rear side of the guide pillar; an air-stopping element is disposed on the outer surrounding of the rear end of the guide pillar, moving with the guide pillar to touch or leave the rear end of the bushing; an air outlet is formed on the front end of the guide pillar; at least one air-guiding hole in fluid communications with the air outlet is formed in the radial direction on the sidewall of the guide pillar in the vicinity of the air outlet; an annular groove in fluid communication with the air guiding holes is formed around the front end of the guide pillar; at least one connecting hole goes through the front end of the bushing; the pressurized air entering the action space via the first flow path flows via the connecting holes into the space between the bushing and the bolt; a receiving part for air to drive surrounds the rear end of the bolt; a first receiving surface is formed on the side of the receiving part that faces the air-stopping element; a second receiving surface is formed on the side of the receiving part away from the air-stopping element; the bolt urges against the front end of the air-stopping element by the first receiving surface of the receiving part; the front end of the bolt has several ventilation holes in fluid communications with the air outlet; the cross sections of the airflow space and the first receiving surface are larger than the cross section of the second receiving surface; and one end of the control valve is in fluid communications with the space between the bushing and the inner wall of the body passage via a fourth flow path, and the other end is in fluid communications with the airflow space formed between the rear end of the guide pillar and the front end of the base via a fifth flow path.

5. The structure of a paintball gun as in claim 4, wherein the guide pillar has a third flow path for air to flow through and the third flow path guides the air near the air outlet to the space between the bushing and the guide pillar.

* * * * *